United States Patent [19]

Cortlever et al.

[11] Patent Number: 4,755,080

[45] Date of Patent: Jul. 5, 1988

[54] DEVICE FOR INSERTING A DRAINAGE WICK INTO THE GROUND

[76] Inventors: Nico G. Cortlever, Vinkeveen, Netherlands; Nic G. Cortlever, 220 Baambrugse Zuwe, 3645 AM Vinkeveen, Netherlands

[21] Appl. No.: 933,183

[22] Filed: Nov. 21, 1986

[30] Foreign Application Priority Data

Dec. 9, 1985 [NL] Netherlands ..... 8503390

[51] Int. Cl.[4] ..... E02B 11/00; E02D 3/10

[52] U.S. Cl. ..... 405/50; 173/22; 405/232

[58] Field of Search ..... 405/36, 50, 52, 43–49, 405/228, 232, 245–247; 254/29 R; 175/171; 111/1, 3, 4, 6, 7; 173/22, 25, 26, 85, 86

[56] References Cited

U.S. PATENT DOCUMENTS

| | | | |
|---|---|---|---|
| 1,973,197 | 9/1934 | Baker | 173/85 |
| 2,476,390 | 7/1949 | Simmonds | 173/86 X |
| 3,477,237 | 11/1969 | Orkney | 405/232 |
| 3,869,003 | 3/1975 | Yamada et al. | 405/232 X |
| 4,166,508 | 9/1979 | van der Berg | 405/50 X |
| 4,170,340 | 10/1979 | Mouton | 254/29 R X |
| 4,195,698 | 4/1980 | Nakagawasai | 405/232 X |
| 4,249,600 | 2/1981 | Bailey | 254/29 R X |
| 4,455,105 | 6/1984 | Juhola | 405/50 |
| 4,626,138 | 12/1986 | Boyes | 405/232 |

*Primary Examiner*—David H. Corbin

*Attorney, Agent, or Firm*—John P. Snyder

[57] ABSTRACT

In inserting a drainage wick into the ground, a tube containing the drainage wick is plunged into the ground with continuous downward driving force, whereafter the tube is withdrawn leaving the wick embedded in the ground.

8 Claims, 3 Drawing Sheets

DEVICE FOR INSERTING A DRAINAGE WICK INTO THE GROUND

Figure 1:
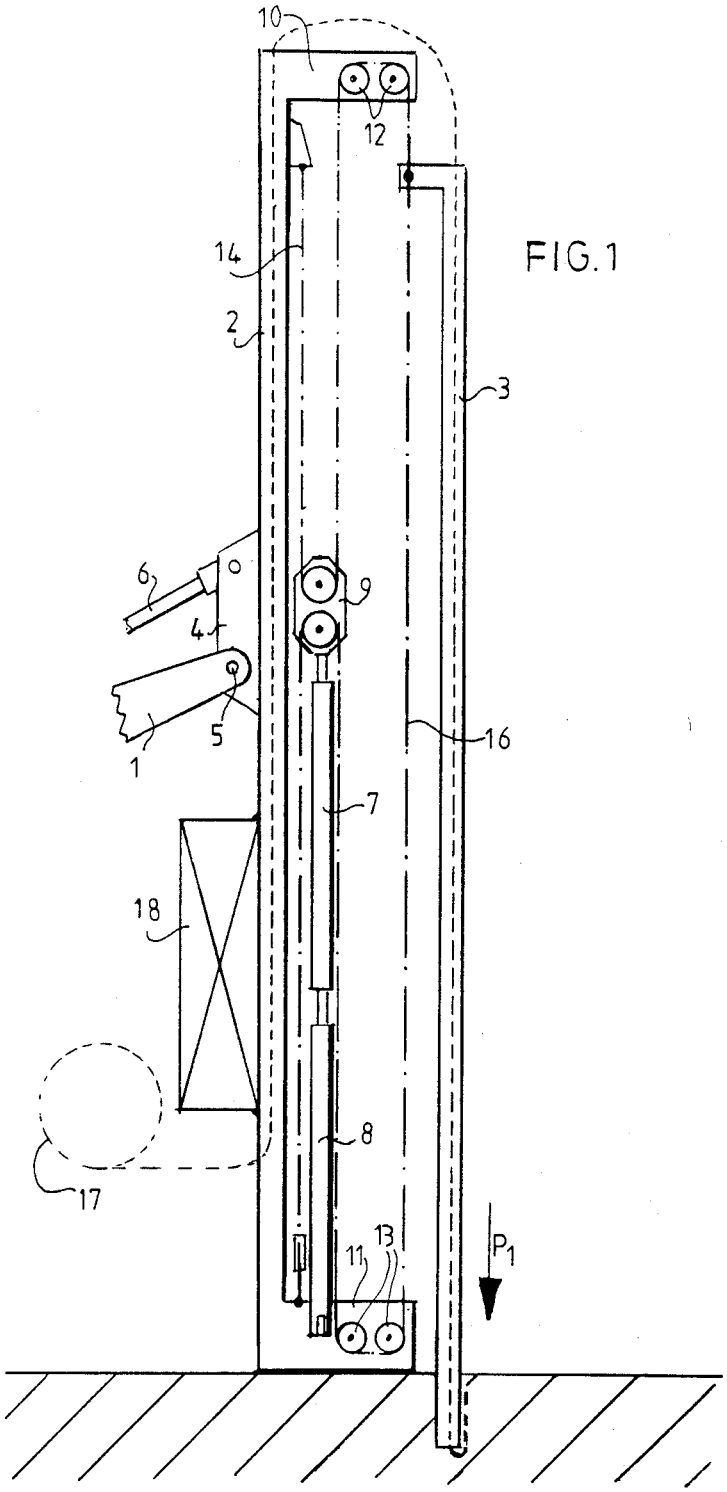

The invention concerns a device for inserting into the ground a drainage wick consisting of a profiled core and water permeable sleeve, said device consisting mainly of a mobile machine such as a backhoe, with a mast, and attached to the mast a rectangular tube, holding a drainage wick, and being able to move up and down along the mast in a vertical manner.

In order to insert water or to de-water soil it is customary to insert a drainage wick vertically in the soil, to for example a depth of 10 m. Such a drainage wick inserted by means of a tube, such tube being driven into the ground. When such tube is extracted from the ground, the drainage wick remains in the soil, the soil pressurizes against the wick, and water may travel through the permeable sleeve of the wick along the wick either up or down, depending on the function.

It is common practice to drive the aforementioned tube into the ground by means of pile driving leads. Such leads of themselves are relatively heavy, and the driving activity is relatively slow. As drainage wicks are inserted at a frequency of 2 to 3 meters, for example on a dike pad, relatively much time is needed in order to introduce the number of wicks required.

This invention has for its object to resolve this problem by providing means to inserting wicks into the ground at a much faster rate. The device according to the invention is distinguished in that the tube inserting the wick is inserted into the ground by a hydraulic cylinder which is supported on the mast. This cylinder may be hydraulic or pneumatic with advantage that such cylinder will apply a continuous driving force to the tube with the result that the drainage wick will be inserted into the ground at a much faster rate. Moreover the device can be built lighter and may be used by attaching it to a standard hydraulic backhoe, having the backhoe bucket removed, and the linkages and hydraulic arm attached to the mast with the installation tube. Such a setup will be far more mobile than the traditional pile driving leads, and maybe moved on and around the job site much more easily than traditional equipment.

In order to obtain an optimum power distribution on the cylinder, which must be relatively long, it is desirable to fix a flexible attachment such as a cable or chain, between the cylinder and the tube, this flexible attachment being fixed to a sheave on the mast.

The cylinder is preferably provided with a sheave carrier around which the cable is formed. Hereby is achieved a two times or a multiple insertion speed, in comparison with the capacity or stroke of the cylinder thus again shortening the time needed to insert the tube.

The invention furthermore provides for two cylinders placed in series (one after the other). Hereby it will be possible to keep the shaft diameter of the cylinder relatively small, so that small hydraulic capacity is needed whilst providing for large displacement. Because of the slenderness of the hydraulic cylinders, it is preferred to provide for a guide path for each of the cylinders attached to the mast.

Figure 2:
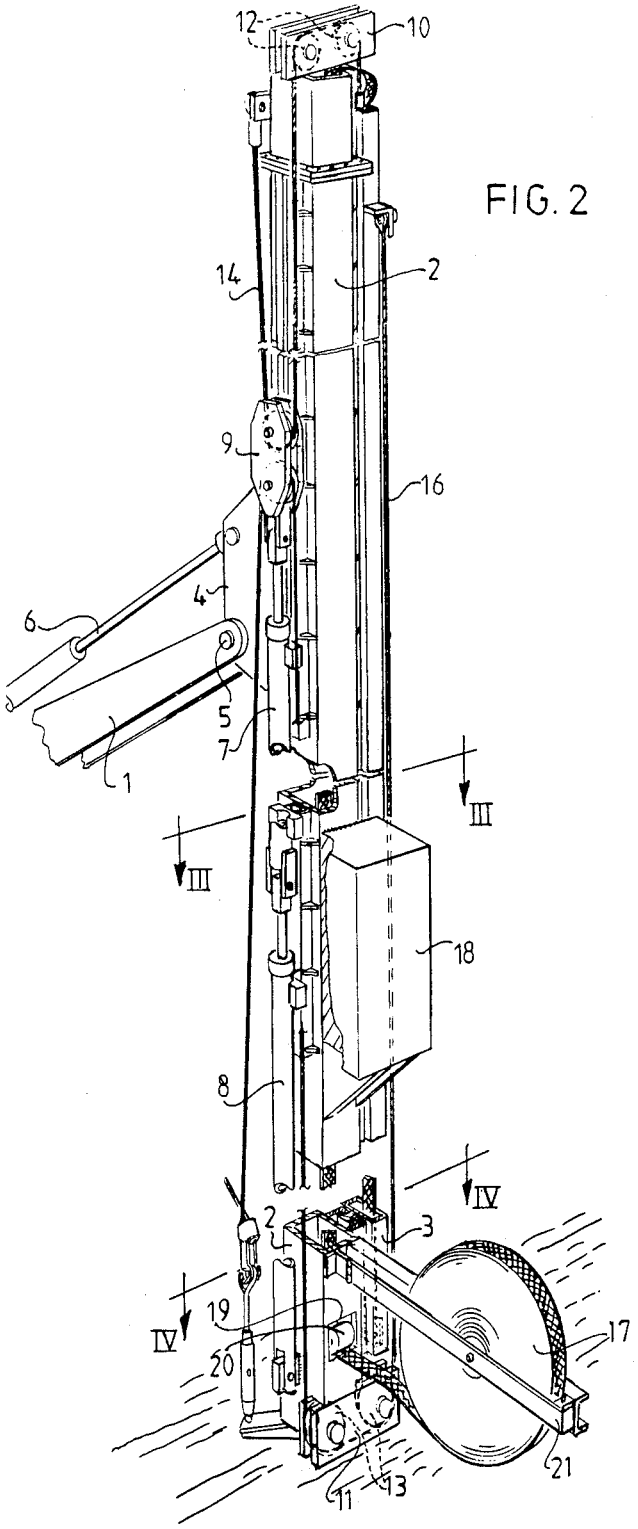
Figure 3:
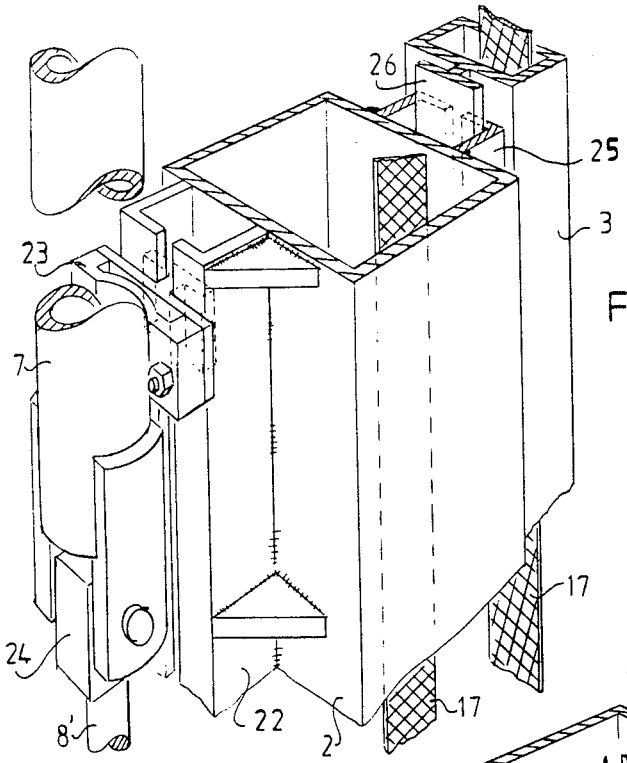
Figure 4:
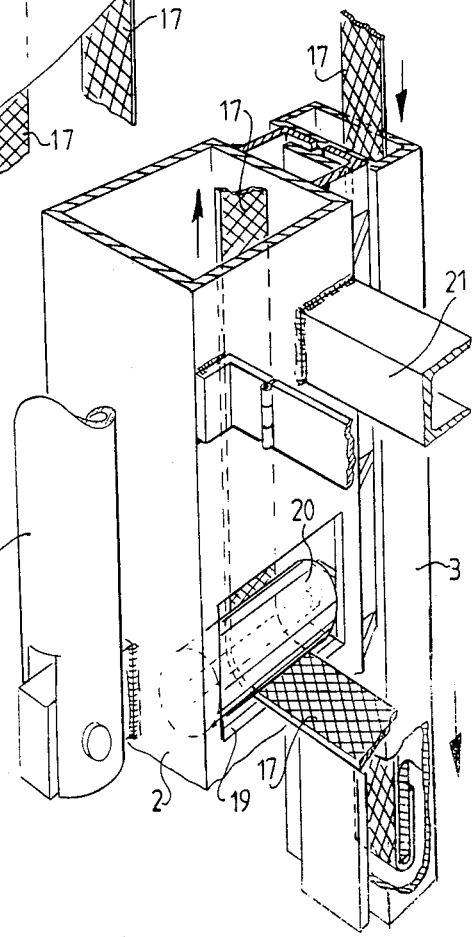

The invention is further described in the detailed description of an embodiment as depicted and explained below. In the drawings is:

FIG. 1 a schematic side view of the various parts of the equipment according to the invention showing the cable connections, and tube travel, FIG. 2 a perspective view of the device according to a first embodiment, FIGS. 3 & 4, each a perspective view of a part of the device in FIG. 2 according to the cross sections III—III, IV—IV in FIG. 2 respectively.

The equipment as depicted in the drawings consists principally of a mobile machine 1, carrying a mast 2, wherein a tube 3 may be moved up and down in a vertical sense. It should be noted that the mobile equipment 1 can be any type of equipment, such as a hydraulic backhoe or excavator, in FIG. 1 only the arm of which is schematically shown. This arm is attached to the mast 2 with connector 4 which is journalled around pin 5 attached to the arm. A hydraulic cylinder 6 of the device is able to bring the connector piece and thereby the mast 2 about pin 5 in a vertical position.

The mast 2 is furthermore provided with a pair of hydraulic cylinders 7 and 8 connected in series, with one end of the bottom cylinder 8 supported on the mast 2 whilst the cylinder rod of the upper cylinder 7 supports the sheave housing for block 9. At both ends of the mast there is a housing 10 and 11, in each of which a pair of sheaves 12 and 13 are mounted. The system comprises a flexible element 14, fastened to the top of the mast 2, and led around the upper sheave of block 9, around the sheave system 12, and finally secured to the tube 3. A similar flexible element 16 is secured to the bottom of the mast 2, led around the bottom block of sheave 9, furthermore around the bottom sheave system 13 and also secured to tube 3.

From a supply roller drainage wick 17 is led upwards via the mast 2 and subsequently inserted into tube 3, so that the bottom end of the wick protrudes from the lower end of the tube 3.

By folding around or attaching an anchor plate, the wick 17 will be carried into the ground in the direction of arrow P1, until tube 3 is entirely inserted into the ground. By means of extraction of tube 3 the folded over end of the wick 17 shall remain in the ground and will allow the tube 3 to move upwards freely. As soon as tube 3 is entirely extracted the wick 17 may be cut off from the bottom of the tube 3 and subsequently the whole process may be repeated.

The insertion of tube 3 is made possible by applying power to cylinder 7 and 8 either simultaneously or consecutively. The supply of power to cylinders 7 and 8 is provided by the main hydraulics of the hydraulic machine 1 and shall provide for the action of cylinder 7 and 8 to cause the equipment to produce the cycle starting from a position as shown in FIG. 1. Thus cylinder 7 shall move upwards relative to cylinder 8 and block 9 will move relative to cylinder 7 and 8. As the block 9 moves upwards, the right part of flexible element 16 will move at twice the rate of block 9 while inserting tube 3.

In order to extract tube 3 from the ground, cylinders 7 and 8 must be activated inversely, so that flexible element 14 will extract tube 3 twice as fast upwards as the movement of block 9.

Finally it must be noted in order to achieve sufficient counter pressure to inserting the tube 3, a counter weight 18 may be attached to mast 2.

Actual construction details are shown in FIGS. 2 and 3. From these figures it is clear that the mast consists of a hollow square tube, which is provided with an opening 19 at the bottom with a guide roll 20, which provides for the smooth carriage of the wick 17. This roll of wick 17 may spin freely on carrier 21 which is suitably attached to the mast opposite said hydraulic implement 1.

The mast is fitted at the adjacent side with a guide rail 22 (see FIG. 3) whereby a guide block 23 can move up and down. This guide block is attached to the bottom end of the upper cylinder 7 as well via a connector piece 24, pivotably connected to the cylinder rod 8' of the bottom cylinder.

Similarly block 9 could be inserted into the guide rail 22. The guide rail 22 therefore provides for an optimum power distribution for both cylinders 7 and 8, so that slender and relatively small cylinder diameters may be used. This speeds up the operation of the equipment substantially because only a relatively small amount of hydraulic fluid, like oil, is needed.

The mast 2 is fitted on the opposite side with a similar guide rail 25, along which the tube 3 may be moved up and down. To this end tube 3 has been fitted with a T-rail 26, which fits into the guide rail 25 comprising two L-profiles.

From the above it will become obvious that the equipment may be embodied relatively light, and is capable of being moved and set up at a very fast rate. It has been proven that the cycle time to inserting drainage wick may be reduced to within ⅓ of the usual insertion time.

This invention is not restricted to the above described embodiment. For example the block 9 does not have to be provided for but the cable may be attached directly to cylinder head of 7, whereby the multiple insertion speed is obviously eliminated, but the slender hydraulic cylinders may be maintained.

Alternatively it is also possible to attach multiple sheaves therefore providing for a four or more multiple insertion speed.

I claim:

1. A device for inserting a drainage wick into the ground which comprises a mobile frame having a mast, a cable system supported on the mast and presenting a vertical cable run, a vertically elongate wick-inserting tube presenting an upper end and a lower end and connected at its upper end to the cable run, piston/cylinder means connected to the cable system for causing said cable run to plunge the tube downwardly into the ground and to withdraw the tube from the ground, and wick supply means on said frame for feeding wick downwardly through the tube so that the wick will follow the tube as it is plunged downwardly into the soil but will become embedded in the ground when the tube is withdrawn from the ground.

2. A device as defined in claim 1 wherein the cable system comprises a length of cable dead-ended at its opposite ends to the frame, a block having at least two pulleys thereon over which the cable is reeved, said piston/cylinder means being connected to the block for moving it up and down.

3. A device as defined in claim 2 wherein the piston/-cylinder means comprises two piston/cylinder assemblies connected in series.

4. A device as defined in claim 3 including guide means carried by the mast for positively guiding the piston/cylinder assemblies.

5. A device for inserting a drainage wick into the ground which comprises a mobile frame having a mast, a wick-inserting tube of vertically elongate form to present upper and lower ends, a drainage wick received in and extending through the tube, means for guidably mounting the tube on the mast for vertical motion relative thereto between an elevated position in which the lower end of the tube is spaced above the ground and a lowered position in which the lower end of the tube is plunged into the ground, piston/cylinder means connected to the tube adjacent the upper end thereof for applying a continuous downward driving force on the tube as it is plunged into the ground the piston/cylinder means for applying a continuous downward driving force including a length of cable dead-ended at its opposite ends to the frame, a block having at least one pulley thereon over which the cable is reeved, said piston/cylinder means being connected to the block for moving it up and down.

6. A device as defined in claim 5 wherein the piston/-cylinder means comprises two piston/cylinder assemblies conncted in series.

7. A device for inserting a drainage wick into the ground which comprises a mobile frame having a mast, a wick-inserting tube of vertically elongate form to present upper and lower ends, a drainage wick received in and extending through the tube, means for guidably mounting the tube on the mast for vertical motion relative thereto between an elevated position in which the lower end of the tube is spaced above the ground and a lowered position in which the lower end of the tube is plunged into the ground, piston/cylinder means connected to the tube adjaent the upper end thereof for applying a continuous downward driving force on the tube as it is plunged into the ground the piston/cylinder means for applying a continous downward driving force including a length of cable dead-ended at its opposite ends to the frame, a block having at least two pulleys thereon over which the cable is reeved, said piston/cylinder means being connected to the block for moving it up and down.

8. A device as defined in claim 7 including guide means carried by the mast for positively guiding the piston/cylinder means.

* * * * *